US005871103A

United States Patent [19]

Durst

[11] Patent Number: 5,871,103

[45] Date of Patent: Feb. 16, 1999

[54] DEVICE AND PROCESS FOR THE SEPARATION AND CLASSIFICATION OF PARTICLES FORMING GRANULAR PRODUCT

[76] Inventor: Laurent Durst, Chemin des Haies - 1442, Montagny-Pres-Yverdon, Switzerland

[21] Appl. No.: 750,105

[22] PCT Filed: May 31, 1995

[86] PCT No.: PCT/CH95/00126

§ 371 Date: Nov. 26, 1996

§ 102(e) Date: Nov. 26, 1996

[87] PCT Pub. No.: WO95/32810

PCT Pub. Date: Dec. 7, 1995

[30] Foreign Application Priority Data

Jun. 1, 1994 [FR] France ..... 94/07092

[51] Int. Cl.[6] ..... B07B 4/00

[52] U.S. Cl. ..... 209/135; 209/142; 209/156; 209/208

[58] Field of Search ..... 209/135, 142, 209/146, 147, 156, 208

[56] References Cited

U.S. PATENT DOCUMENTS

| | | | |
|---|---|---|---|
| 2,828,011 | 3/1958 | Whitby | 209/147 |
| 2,946,438 | 7/1960 | Belugou et al. | 209/156 |
| 3,109,807 | 11/1963 | Sauermann | 209/147 |
| 3,385,436 | 5/1968 | Murphy | 209/135 |
| 4,213,852 | 7/1980 | Etkin . | |
| 4,304,661 | 12/1981 | Nelson | 209/146 |
| 4,950,388 | 8/1990 | Stafford | 209/147 |
| 5,006,226 | 4/1991 | Burt, Jr. | 209/147 |
| 5,032,256 | 7/1991 | Vickery | 209/135 |
| 5,039,534 | 8/1991 | Adams et al. | 209/156 |
| 5,232,096 | 8/1993 | Weit | 209/135 |
| 5,267,653 | 12/1993 | Anani | 209/156 |

FOREIGN PATENT DOCUMENTS

| | | | |
|---|---|---|---|
| 975.556 | 3/1951 | France . | |
| 1 808 891 | 6/1970 | Germany . | |
| 26 57 754 | 6/1978 | Germany . | |
| 1161881 | 8/1969 | United Kingdom . | |
| 89/04802 | 6/1989 | WIPO | 209/147 |

*Primary Examiner*—David A. Bucci
*Assistant Examiner*—Douglas Hess
*Attorney, Agent, or Firm*—Young & Thompson

[57] ABSTRACT

The device (10) includes a cylindrical guiding channel (16) communicating with a lower container (17) formed with two parallel planar walls (21) separated by a distance smaller than the maximum width of the guiding channel. The device is further provided with a motion generator (24) arranged to generate a substantially laminar fluid flow in the guiding channel for conveying particles to the guiding channel. The particles introduced in the guiding channel (16) receive the kinetic energy of the fluid flow, fall in the lower container (17) and are recovered at positions which depend of the mass and the kinetic energy received.

13 Claims, 3 Drawing Sheets

DEVICE AND PROCESS FOR THE SEPARATION AND CLASSIFICATION OF PARTICLES FORMING GRANULAR PRODUCT

The present invention relates to a device for the separation and classification of particles forming a granular product, this device comprising a vessel for separation of particles, means for supplying particles to the vessel, a separation means for these particles formed of at least one movement generator arranged to generate in said separation vessel a longitudinal flow of a fluid entraining said particles, and means for recovery of said particles.

It also relates to a process for the separation and classification of particles forming a granular product, in which said particles are progressively introduced into a separation device as defined above, and the particles are collected on at least one recovery means disposed below said vessel, having account for their longitudinal position on these recovery means.

Several known processes permit the separation of particles constituting a granular product such as a powder, pellets or grains.

Among these processes can be cited the separation by screening which consists in disposing the product on a series of superposed screens having progressively finer mesh, and recovering the product on each screen.

This process has various drawbacks due particularly to clogging of the screen and erosion of the particles against the mesh of the screen.

Another process permitting the separation and classification of particles of a granular product, as well as the device for practicing it, are described in U.S. Pat. No. 4,213,852. The device comprises a closed vessel in which is disposed a tube having one upstream end and one downstream end. A hopper is disposed above this tube adjacent its upstream end and permits introducing the particles. A fan is mounted adjacent the downstream opening of the tube and generates an air flow in a closed circuit, circulating in one direction in the tube and in the other direction between the tube and the closed vessel. Wire are disposed adjacent the upstream end of the tube so as to decrease turbulence in the air flow and thereby to create as laminar a flow as possible. Recovery vessels are disposed in the bottom of the tube, particularly along the axis of this tube. The assembly of the device is arranged to decrease to the maximum the losses of pressure in the tube.

When the particles are introduced into the tube from the hopper, they are entrained by the air flow over a distance depending on their weight and their surface perpendicular to the air flow. These particles then fall into recovery vessels and are separated in fractions.

This device has various drawbacks. In particular, the laminar flow that is sought is difficult to produce with a device of this type because of the shape of the vessel and of the circuit the air must follow. In practice, a substantially laminar flow cannot be obtained except at relatively low flow rates, which does not permit assorting heavy particles. This device is adapted to sort particles whose diameter is comprised between 10 and 1000 $\mu$m.

French patent No. 975,556 discloses a process for separation and classification of heterogeneous materials as well as a device for practicing this process. This device comprises means for supplying particles to a separation chamber. The particles are carried by a fluid stream through a conduit in a rotatable drum which opens into said chamber. This separation chamber comprises an upper portion in which circulates a flow of fluid and a lower portion in which the flow of fluid does not circulate. The lower portion of this chamber is provided with screens comprising movable vanes which permit recovering the particles propelled by the fluid flow and which fall by gravity into these latter. The screens are also provided at their base with an annular perforated distributor permitting generating a vertical fluid flow to keep the lightest particles in suspension in the chamber. This device which has many movable parts is complicated to produce.

The present invention proposes overcoming these drawbacks by providing a device and a process permitting obtaining a homogeneous flow for high flow speeds, which permits separating large size particles and thereby increasing the industrial applications of the device.

This object is achieved by a device in which the lower receptacle comprises two flat parallel walls and a bottom comprising at least one opening, the distance between these two flat walls being less than the maximum width of the guide channel.

According to a preferred embodiment, the guide channel is substantially cylindrical and is open at its two ends.

According to a desirable modification, the movement generator comprises a pump disposed upstream of the guide channel and arranged to propel the fluid through this channel.

The device preferably comprises at least one source of fluid arranged to generate a descending fluid flow, perpendicular to the longitudinal flow of fluid generated by the movement generator.

According to a desirable embodiment, the device comprises at least one vibration generator arranged to generate a vibration of the fluid in the guide channel, in one transverse direction relative to the longitudinal flow generated by the movement generator.

According to a preferred embodiment, the device comprises weighing means arranged to measure the mass of the particles as a function of their position on said recovery means, and a data processing device arranged to record these masses and positions.

This object is also achieved by a process as defined in the preamble and characterized in that a longitudinal flow of a fluid is generated in the guide channel, without generating fluid flow in the lower receptacle.

According to a first embodiment, each transverse portion of particles on the recovery means are weighed, a curve of the mass of each portion is established as a function of its position on the recovery means and the curve of the mass of each portion as a function of its position on the recovery means is compared to a similar curve produced by using a reference granular particle whose characteristics are known.

According to a modified embodiment, a descending fluid flow is generated in a direction substantially perpendicular to the direction of the longitudinal fluid flow generated by said movement generator.

According to another embodiment, horizontal transverse vibrations are generated in the separation device.

The present invention and its advantages will become clearer with reference to the preferred embodiments of the present invention and to the accompanying drawings, in which.

Figure 1:
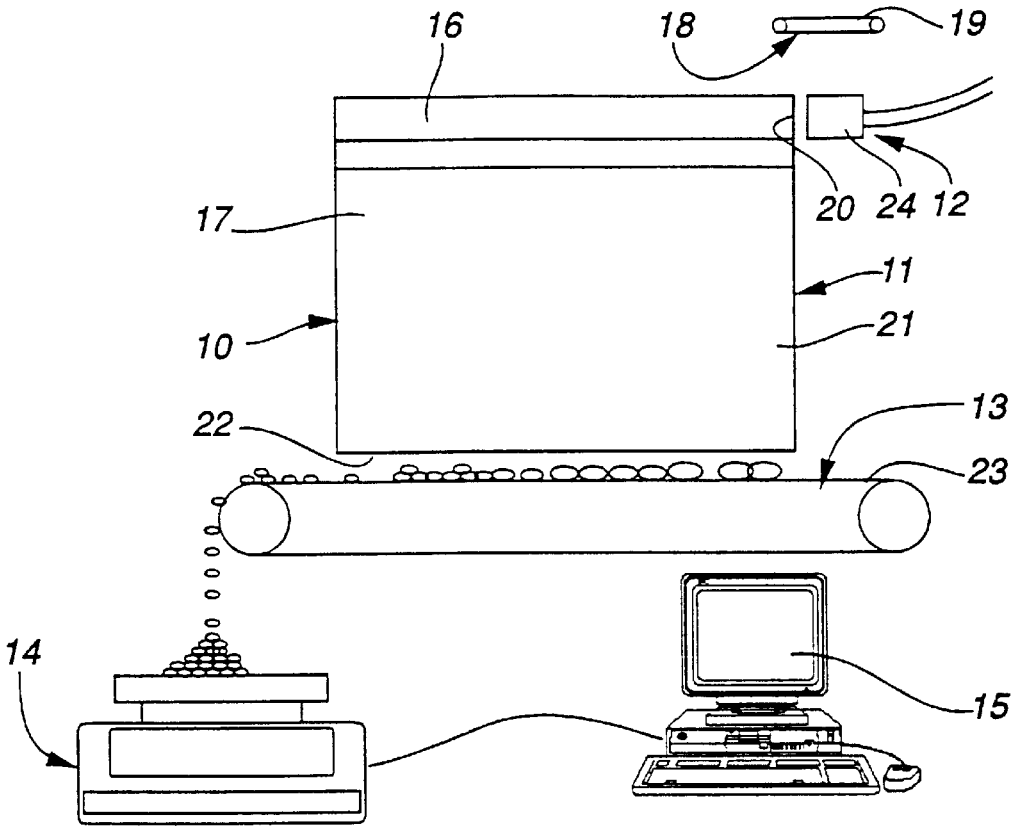
FIG. 1 is an assembly view of the device according to the present invention.
Figure 2:
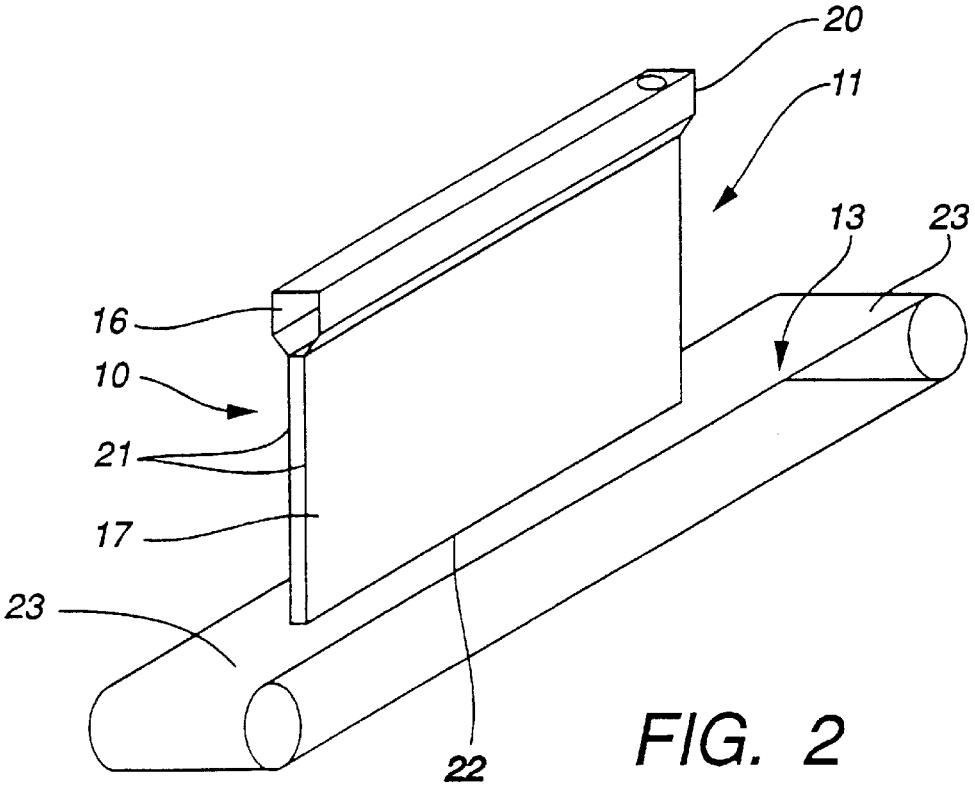
FIG. 2 is a perspective view of the separation vessel and the recovery means of the device according to the present invention.

Referring to FIGS. 1 and 2, the device 10 according to the present invention, comprises essentially a separation vessel 11 for particles comprising the granular product, a separation means 12 for said particles, recovery means 13 for these particles, weighing means 14 and a data processing device 15.

The separation vessel 11 is formed from a cylindrical guide channel 16 open at its two ends, and from a lower receptacle 17 closed at its two ends and disposed below the guide channel. The channel 16 and the receptacle 17 communicate over all their length.

The guide channel is associated with means 18 for supplying said particles, these supply means comprising for example a belt conveyor 19 arranged to transport particles of the granular product to be separated from a source of particles (not shown) to a first end 20, a so-called downstream end, of the guide channel 16.

The lower receptacle 17 is formed by two flat parallel walls 21 spaced apart a distance less than the maximum width of the guide channel 16 and greater than the greatest dimension of the particles to be sorted. This receptacle 17 comprises an open bottom 22 disposed above recovery means 13. These latter comprise an endless conveyor 23, extending over all the length of the vessel 11.

The separation means 12 comprises a movement generator 24 disposed at the downstream end 20 of the guide channel 16 and disposed such that it generates a substantially homogeneous flow of fluid longitudinally in the canal. The movement generator 24 can for example be a pump, a blower or a source of water and its nature depends on the product to be separated. It must be able to transmit a part of the energy of the fluid stream to the particles, without having any chemical interaction with these particles.

The weighing means 14 are disposed below one end of the belt conveyor 23 such that upon displacing this belt, a portion of these particles that it carries will fall on said weighing means.

The data processing means 15 is connected to the weighing means 14 and is arranged to record the masses measured by this weighing means as well as displacement of the endless conveyor 23.

A separation device 10 described above is essentially used for three different operations, namely, the production of a reference curve, the qualification of a product and the sorting of the particles which constitute a granular product.

To produce a reference curve, one proceeds in the following manner:

- a granular reference particle whose characteristics are known, is introduced into the separation vessel 11;
- simultaneously, there is generated in the guide channel 16 a substantially homogeneous and longitudinal fluid flow, of constant amplitude. This flow is for example an air flow;
- the endless belt conveyor 23 being immobile, all the particles can be accumulated in the device.

The fluid flow transmits a portion of its kinetic energy to the particles. Each particle receives a quantity of kinetic energy which depends on different parameters such as the transverse surface, which can vary at any moment, and the frictional coefficient between the particles and the fluid. These particles therefore have a speed having a horizontal component due to the fluid flow and a vertical component due to the earth's gravity. The particles follow a parabolic path and fall on the recovery means 13 at positions depending on the different parameters mentioned above. The fluid flux is subject to a pressure drop within the guide channel 16, this pressure drop being used to improve the separation of the particles. The fluid therefore does not supply to the particles a constant energy no matter what the location of the guide channel in which these particles are located, but it has an energy gradient.

The conveyor belt 23 is advanced by a distance corresponding to the desired measurement resolution;

- the particles that have fallen on the weighing means 14 are weighed;
- this mass is recorded, as well as a positional reference, in the data processing device 15;
- the particles are removed from the weighing means 14, the conveyor belt is again advanced and the particles that have fallen on the weighing means are weighed. This operation is repeated until there are no further particles on the conveyor belt.

Figure 3:
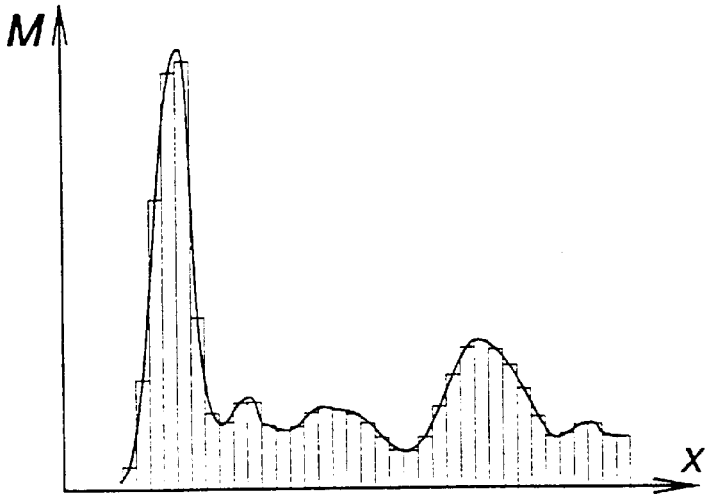
FIG. 3 is a curve showing the quantity of product obtained as a function of the position on the recovery means.

There can thus be established a reference curve such as is illustrated in FIG. 3, which is representative of the distribution of the particles of a given reference product for given measurement conditions.

When it is desired to classify a granular product, the same process as above is followed, so as to obtained a distribution curve of the particles of this product. This distribution curve is then compared to the reference curve, which permits observing the possible displacement of the peaks of the distribution curve relative to the reference curve. The displacement of the peaks can for example be a sign of aging of the product, agglomeration or bonding of the particles. It can also signal dehydration or water absorption.

Finally, the third operation which can be carried out with the separation device of FIGS. 1 and 2, namely, the sorting of the particles forming a product, consists in separating these particles into different classes depending on their position on the conveyor belt and using only the fractions of interest.

Figure 4:
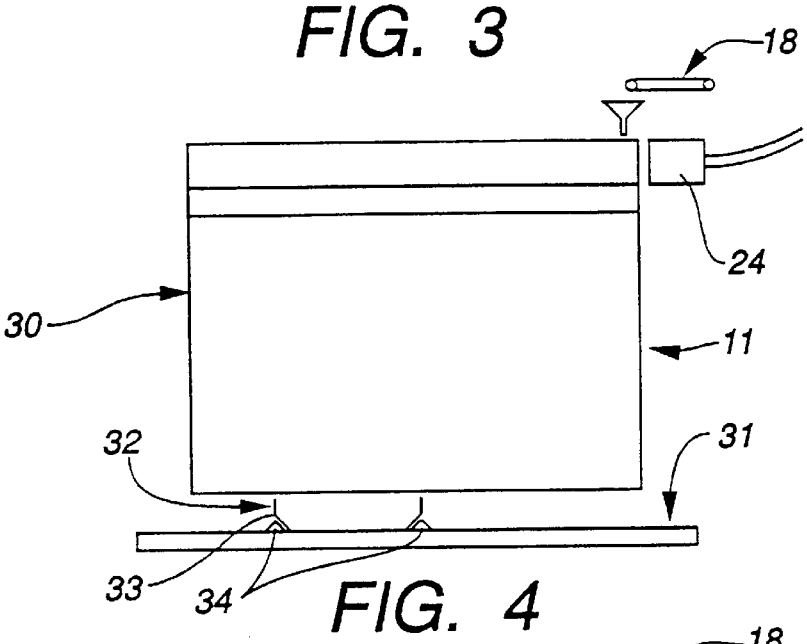
FIGS. 4 to 6 show modified embodiments of the device according to the invention.

The separation device as illustrated in FIG. 4 differs from that of FIGS. 1 and 2 essentially by the recovery means 31. These comprise a separation element 32 provided in the form of a container 33 disposed below the bottom of the vessel between two positioning abutments 34. This device is essentially used to separate particles of a product of which only one fraction is of interest. The container is disposed in a position such that the fraction of interest of the granular product falls into this latter when all of the particles pass through the separation vessel. Thus, the container permits collecting a product whose content in particles of interest is particularly high, whilst the product falling on the recovery means beyond the container 33 has a content of particles of little or no interest.

Figure 5:
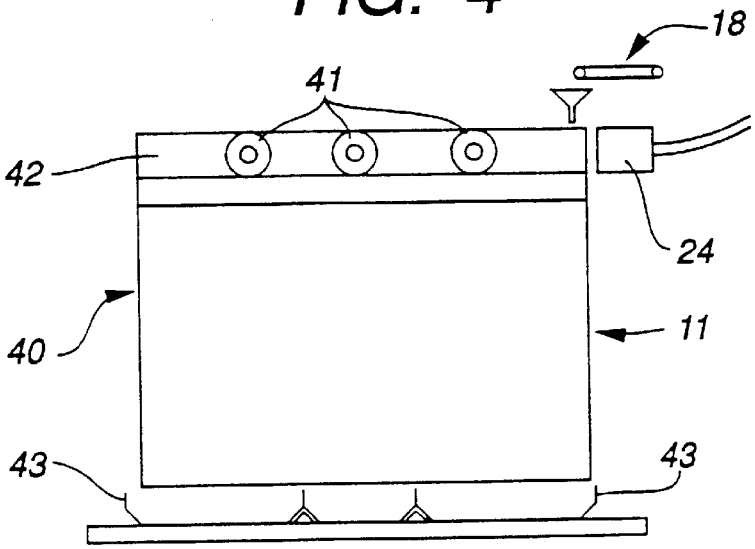

The separation device 40 shown in FIG. 5 comprises three vibration generators 41 disposed along the guide channel 42 in the upper portion of this latter. These three vibration generators give rise to a transverse acoustic wave in the channel, these waves having each a separate frequency and/or different amplitude. They have the object of modifying the path of the particles passing in their immediate proximity. The light particles passing one of these generators 41 will have their path strongly diverted whilst the heavy particles will be only slightly influenced by these acoustic waves. Thus, the distribution of the particles on the recovery means can be modified by addition of these vibration generators. A container 43 is moreover placed below each of these generators 41 slightly offset forwardly, so as to recover the particles in three distinct lots. It is possible to modify the amplitude and frequency of the vibrations, as well as the speed of flow of the fluid so as to obtain optimum separation.

Figure 6:
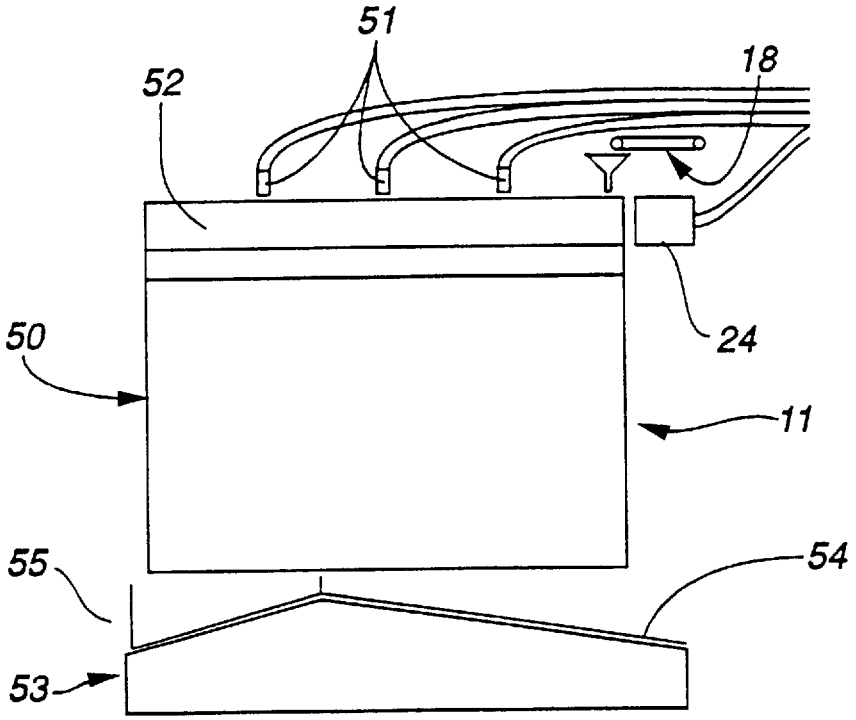

In the separation device 50 illustrated in FIG. 6, three fluid sources 51 are disposed above the guide channel 52 so as to generate in this channel a vertical descending fluid flow. These sources 51 of fluid have the same function as the vibration generators 41 illustrated in FIG. 5. The recovery means 53 comprise two containers 54, 55 of which one, 54, is open and connected to evacuation means (not shown) and of which the other, 55, is closed. This device is particularly adapted to separate the usable particles from a mixture of particles. As in the embodiment shown in FIG. 5, it is possible to vary the speeds of the different flows, so as to obtain the best separation possible. These speeds of flow are determined experimentally as a function of the type of product to be sorted and of the desired result.

The device according to the present invention can be used in numerous fields for the separation, sorting, classification and inspection of granular products. For each type of use and for each form of desired result, the different components of the device and particularly the generator of movements and the recovery means must be suitable. Among the numerous uses possible, can be cited several examples.

In a production line in which is used a granular product such as a food powder for example, it is desired to control the stability of various parameters of the product, these parameters being its composition, the size of the particles which form it, their water content, etc. To do this, it suffices to provide a curve representing the mass of particles by transverse fractions on the belt conveyor and to compare this curve to a reference curve. This type of measurement permits continuous inspection of the quality of the product. It is thus possible to react almost immediately when the product does not respond to the desired criteria, as shown by an offset or deformation of the distribution curve of the product relative to the reference curve.

When it is desired to separate a usable fraction from a mixture of particles containing a useless fraction, such as seeds in the course of germination in a seed lot with different degrees of maturity, there is disposed a separation element on the recovery means. This separation element can be constituted by a transverse wall or by a recovery vessel into which fall the interesting fraction of the mixture. The determination of the position of the wall or of the vessel permits selecting the utilized fraction of the mixture.

The device according to the present invention can for example also be used to separate gold bearing powder from the rock which contains it. To this end, the rock is ground into fine particles, then introduced into the device. In this embodiment, the fluid circulating in the guide channel is water. Three vertical water jets are disposed at the top of the vessel. These particles are entrained by the longitudinal water flow. When they pass through the first vertical water jet, the heavy particles have a high kinetic energy and their path is substantially unaffected by the water jet. Less dense particles on the other hand are driven to the bottom of the vessel by the first water jet. When the particles arrive at the second water jet, they have lost a portion of their kinetic energy through loss of momentum. The second water jet can thus capture the less dense particles. Finally, the third jet captures the densest particles which can be recovered in a separate container. The gold-bearing particles being the densest, the first receptacle will contain a high proportion of gold.

It is to be noted that the separation process of the present invention is completely compatible with processes presently practiced in the prior art. Thus, it is possible to reuse the reference curves of the given products, established according to other methods. This process moreover permits a particularly fine and precise analysis of the granular products. It is thus possible to refine the reference curves of the prior art.

The separation process according to the present invention moreover permits studying the friability of a product, this study can be carried out by causing a lot of the product to pass through the device, then subjecting this product to compression and causing this same lot to pass through the device. The comparison of the two distribution curves of the particles permits characterizing the friability of the product.

So as to be able to use such a device in a correct manner, it is essential that the fluid flow circulating in the guide channel be the least turbulent possible. This is achieved very easily in the device according to the present invention, because of the geometric shape of this device. The fluid flow circulates essentially in the guide channel. This flow is less affected by the presence of particles because they pass through this channel with only a very short lapse of time. The flow can be relatively less turbulent, even for high speeds, which permits sorting large size particles.

The products used can for example be food powders, vegetable seeds, mechanical members such as watch pieces, mineral mixtures or pharmaceutical granules. The fluid used to generate a flow can for example be a gas such as air or a neutral gas, or a liquid such as water or mercury.

The guide channel can have an annular shape such that the fluid circulates in a closed circuit in the device. In this way, only a small quantity of fluid is necessary and this is not wasted, which can be of interest in the case of an expensive fluid or polluting fluid for example.

The width of the lower receptacle can be adjustable so as to be matched to the dimensions of the particles to be sorted.

The recovery means can be comprised by a conveyor disposed perpendicular to the guide channel. This embodiment is similar to the cases illustrated in FIGS. 4 and 5 in which the recovery means comprise a container. These recovery means can also comprise a container disposed between the parallel walls of the vessel.

The process according to the present invention can be used either only for separating particles forming the granular product, or for separating and classifying them.

It is moreover possible to charge electrically the guide channel so as to separate particles also having an electrical charge, such as for example particles of loaded polyethylene or loaded polyvinyl chloride.

I claim:

1. A device for the separation and classification of particles forming a granular product, said device comprising a separation vessel for the particles, means for supplying particles to the vessel, separation means for said particles comprised by at least one movement generator arranged to generate in said separation vessel a longitudinal flow of a fluid entraining said particles, and means for recovering said particles, the separation vessel comprising a guide channel in which circulates said fluid flow, and a lower receptacle in which the fluid flow does not circulate, this channel and this receptacle being in communication over all their length, the lower receptacle comprising two flat parallel walls and a bottom comprising at least one opening, the distance between said two flat walls being less than the maximum width of the guide channel.

2. Device according to claim 1, wherein the guide channel is substantially cylindrical and open at its two ends.

3. Device according to claim 1, wherein the movement generator comprises a pump disposed upstream of the guide channel and arranged to propel the fluid through said channel.

4. Device according to claim 1, which further comprises at least one fluid source arranged to generate a descending fluid flow, perpendicular to the longitudinal fluid flow generated by the movement generator.

5. Device according to claim 1, which further comprises at least one vibration generator arranged to generate a vibration of the fluid in the guide channel, in a direction transverse relative to the longitudinal flow generated by the movement generator.

6. Device according to claim 1, which further comprises weighing means arranged to measure the mass of the particles as a function of their position on said recovery means, and a data processing device arranged to record said mass and said position.

7. A process for separating particles in a granular product, comprising the steps of:

generating a longitudinal flow of a fluid entraining the granular product in a guide channel;

allowing the particles in the granular product to descend from the guide channel to a lower receptacle in which the fluid flow is not generated, the guide channel and the lower receptacle being in fluid communication along their length, the lower receptacle having flat parallel walls spaced apart less than a maximum width of the guide channel and a bottom with an opening through which the particles exit; and recovering the particles exiting from the lower receptacle based on positions of the particles along the length of the lower receptacle.

8. The process of claim 7, further comprising the steps of weighing the particles recovered at the positions along the length of the lower receptacle and determining a relationship of a mass of the particles recovered to the position at which the particles were recovered.

9. The process of claim 8, further comprising the step of comparing the determined relationship to a known relationship of mass to position for a reference granular product.

10. The process of claim 7, further comprising the step of generating a further fluid flow in the guide channel that is at an angle to the longitudinal flow and toward the lower receptacle.

11. The process of claim 7, further comprising the step of generating horizontal transverse vibrations in the guide channel.

12. A process for separating particles in a granular product, comprising the steps of:

generating a longitudinal flow of a fluid entraining the granular product in a guide channel;

generating along a length of the guide channel a turbulent lower boundary for the longitudinal flow of fluid to cause a longitudinal energy gradient along the length of the guide channel;

allowing the particles in the granular product to descend from the guide channel through the turbulent lower boundary; and recovering the particles exiting from the lower boundary based on positions of the particles along the length of the guide channel.

13. The process of claim 12, further comprising the step of generating a further fluid flow in the guide channel that is at an angle to the longitudinal flow to change the energy gradient.

* * * * *